United States Patent [19]

Winkelmann et al.

[11] 4,388,973

[45] Jun. 21, 1983

[54] DIRECT DRILL BIT DRIVE

[75] Inventors: Siegfried Winkelmann, Tettnang; Horst Schulz, Friedrichshafen, both of Fed. Rep. of Germany

[73] Assignee: Zahnradfabrik Friedrichshafen Aktiengesellschaft, Friedrichshafen, Fed. Rep. of Germany

[21] Appl. No.: 249,724

[22] Filed: Mar. 31, 1981

[30] Foreign Application Priority Data

Apr. 2, 1980 [DE] Fed. Rep. of Germany ..... 3012779

[51] Int. Cl.[3] ..... E21B 4/02

[52] U.S. Cl. ..... 175/321; 175/227; 175/107

[58] Field of Search ..... 175/321, 106, 107, 227, 175/228, 229, 319

[56] References Cited

U.S. PATENT DOCUMENTS

| | | | |
|---|---|---|---|
| 2,654,572 | 10/1953 | Arutunoff | 175/106 |
| 2,990,895 | 7/1961 | Works et al. . | |
| 3,594,106 | 7/1971 | Garrison . | |
| 3,669,199 | 6/1972 | Cullen et al. | 175/106 |
| 4,194,582 | 3/1980 | Ostertag | 175/321 |
| 4,329,127 | 5/1982 | Tschirky et al. | 175/107 X |

FOREIGN PATENT DOCUMENTS

| | | |
|---|---|---|
| 1133324 | 7/1962 | Fed. Rep. of Germany . |
| 1170717 | 5/1964 | Fed. Rep. of Germany . |
| 2309521 | 9/1975 | Fed. Rep. of Germany . |
| 2528793 | 3/1979 | Fed. Rep. of Germany . |
| 2752768 | 5/1979 | Fed. Rep. of Germany . |

OTHER PUBLICATIONS

*World Oil*, Jul. 1978, pp. 84 and 86.

*Primary Examiner*—Ernest R. Purser
*Assistant Examiner*—Thuy M. Bui
*Attorney, Agent, or Firm*—Karl F. Ross; Herbert Dubno

[57] ABSTRACT

A direct drive for a drill bit in a drill string has a fluid-operated motor within a drive section connected by a gear section to a bearing section whose inner tube is coupled to the drill bit to accommodate axial displacement of the drill bit within the outer tube, spring elements are braced against a radial bearing for the inner tube which has at least one axially defined race. The coupling between the inner tube and the gearing also accommodates such axial displacement and a reservoir for oil is located between the drive and gear sections so that oil can be fed to the gearing, the bearings and to an axial bearing in an annular oil-filled space between the drive and gear sections.

8 Claims, 7 Drawing Figures

DIRECT DRILL BIT DRIVE

FIELD OF THE INVENTION

The invention relates to a direct drill bit drive.

BACKGROUND OF THE INVENTION

A direct drill bit drive can comprise a respective drive section, gear section and bearing section in which all bearings for the axial support, part of the bearings in the drive section, and all bearings in the drive section, and all bearings in the remaining sections for radial support, together with the gearing, are disposed in an oil-tight closed annular space between a non-rotary outer tube and several rotary inner tubes which are disposed in series in an axial direction, this annular space also acting as an oil reservoir, and the flushing medium being fed through the concentrically disposed inner tubes to the drill bit, which is fixed to the inner tube located in the region of the bearing section.

Alternatively a direct drill bit drive can comprise a respective drive section and bearing section, in which all the bearings for axial support, part of the bearings in the drive section, and all the bearings in the remaining sections for radial support are disposed in an oil-tight closed annular space between a non-rotating outer tube and several rotating inner tubes which are disposed in series in an axial direction, this annular space also comprising an oil reservoir, and the flushing medium being fed through the concentrically disposed inner tubes to the drill bit, which is fixed to the inner tube located in the region of the bearing section.

Such drives are subjected to very severe axial and radial stress. Very strong drilling impacts—the severity of which depend on the drilling method and in particular on the type of rock being drilled—act on the drilling shaft, the gearing and on the drill drive, for example a turbine, so that such installations are not always operationally reliable because of the high impact stress, and in particular can work for only a short time before overhaul, and thus have a short life. The service life of the drill bit cannot at present be utilized fully because of damage to the bearing unit, the gearing or the drive itself.

The publication "Artep Institut Francais du Petrôle" discloses a direct drill bit drive comprising a reduction gear unit in accordance with the first approach described afore, in which the entire drive is made axially rigid, and is thus prone to the aforesaid drawbacks. Such drawbacks also arise in the case of other known drill bit drives without gearing, that is, drives in which the rotational speed of the drive section and the required rotational speed of the drill bit are equal.

OBJECT OF THE INVENTION

The object of the invention is therefore to provide a direct drill bit drive which operates with high operational reliability, and which has a noticeably improved life.

SUMMARY OF THE INVENTION

According to the invention, additional axial bearings for supporting the axial forces arising in the drive section are disposed in the annular space between the drive section and gear section, the bearing section disposed between the gear section and the drill bit has a further coupling which is connected to the exit output of the ger section in a rotatably rigid manner but such that the inner tube carrying the drill bit can effect a large relative axial movement, and in the region of the bearing section, spring elements make it possible to absorb axial forces during the axial displacement of the inner tube and are disposed between the outer tube and inner tube, the roller bearings for radial support make a relatively large axial displacement of the inner tube possible and the roller bearings for the axial support of the drill bit pressure are either resiliently disposed or provide the inner tube with spring action.

By supporting the axially acting forces from the drive section on the basically fixed outer tube, the gearing which follows in the drive line is not loaded in an axial direction.

However, even in direct drill bit drives without reduction gearing, it is advantageous if the output shaft of the drive system (turbine, screw motor) can be disposed in an oil-filled sealed space, and supported on a non-rotating outer tube.

Previously, such axial bearings ran in the corrosive flushing medium, and in order to protect such bearings, care had to be taken that the axial force arising from the drive system and the opposingly directed reaction force of the drill bit were as balanced as possible. In the case of certain types of rock, e.g. soft rock, however this is completely impossible, due to the fact that in this case a high moment is required—high axial force of the drive system—and only a reduced drill bit pressure is simultaneously possible.

By contrast, the axial bearing disposed in a sealed oil-filled space makes it possible for the two opposingly directed axial forces to be properly set independently of each other, without difficulties arising for the bearing system.

The spring elements for the resilient support of the inner pipe carrying the drill bit, together with the relatively large axial displacement which is possible in the region of the radial bearings and also the resiliently disposed axial bearings, are able to absorb all the damaging impacts and vibrations originating from the drill bit, without the radial or axial bearing system for the said drill bit being adversely affected.

The coupling disposed between the bearing section and the drive—gearing, or, for example, a turbine—ensures a rotatably rigid connection in the drive line, while allowing a relatively large and easily effected axial movement of the inner tube carrying the drill bit, even in the case of very high torques.

The roller bearings for radial support have internal or external widened running surfaces in the region of the bearing section.

Because of the fact that the internal or external running surfaces in the rolling bearings for the radial support are widened in an axial direction, the bearing quality in a radial direction is not impaired in spite of the easy-action axial movement of the inner tube.

The spring elements in the bearing section can be disposed between stops on the outer tube and the roller bearings for axial support.

Alternatively the spring elements in the bearing section are disposed between the stops on the inner tube and the roller bearings for axial support.

It is easily possible to dispose the axial bearings in the bearing section on the inner tube in an axially fixed manner, these being mostly present in some number and provided with load compensation, and to support the spring elements between this spring pack and a simple stop on the non-rotating outer tube.

If however the axial bearings are required not to participate in the axial displacement of the drilling bit and therefore of the inner tube, the bearing pack can also be fixed to the outer tube, so that the spring elements are supported on the inner tube.

The spring elements in the bearing section can be multi-layer cup springs or multi-layer helical springs with conical contact surfaces.

This arrangement is particularly advantageous, as it is possible for the layers to lie against each other, but also in opposing directions. By means of a multi-layer arrangement, an increase in axial bearing strength and a lowering of friction are attained.

Friction springs—circular springs—used as spring elements have in addition to the favorable shock-absorbing action also the advantage that they have a very high specific working capacity, and can be accommodated in an annular space. Because of the series arrangement, these springs adapt well to each other.

If cup spring packs are disposed in opposing directions, the layer arrangement produces favourable oil spaces which become reduced during the axial stressing, whereupon part of the oil is forced into another part of the oil space. The axial movement of the drill bit can thus be further damped in conjunction with flow restrictor passages in a pressure ring, disposed between the axial bearings and the, for example, cup springs.

Restrictor passages can be interposed in the annular space in the bearing section between the axial bearings and the spring elements.

The coupling disposed between the drive section—the output from the gearing or inner tube of the drive section itself—and the inner tube carrying the rotary bit, comprises roller elements in axially extending grooves.

The coupling can consist of an outer ring and an innerring coaxial therewith; forces—equally divided semicircular grooves in both rings—are preferably disposed in an axial direction on the separation line between said rings and distributed over the circumference, and balls acting as roller elements are rollably guided therein.

A coupling with axially extending grooves in which roller elements acting as coupling elements is particularly simple and advantageous to construct if it consists of an inner ring and an outer ring disposed coaxial therewith. The grooves which extend in an axial direction have a semicircular profile, and are provided for example by means of bores on the line of separation between these two components and distributed over the circumference. In addition to the simple construction of these grooves, it is also possible to use simple balls as roller elements.

This arrangement has low friction losses both in a radial and also in an axial operating direction, so that even if high torques occur, an easy-action axial displacement and thus reliable operation are ensured. The axial movements arising from drilling impacts of the drill bit are unable by this means to be transmitted to the gearing or to the drive section.

From the Hughes Catalogue 1976–1977, a shock absorber is known which is also suitable for improving the operational reliability and life of deep drilling devices.

However, this shock absorber is inserted into the drilling tube between the drill bit and the drilling shaft driven by the overhead drive, and thus only reduces the action of the drilling impacts on the drilling tube, i.e. is not supported on a non-rotating external tube and therefore is not suitable for a direct drill bit drive. Moreover, such an additional shock absorber increases the constructional length, and this is a drawback, particularly in the case of directional drilling.

BRIEF DESCRIPTION OF THE DRAWING

Further details of the invention will be apparent from the description of one embodiment with reference to the drawings, in which.

SPECIFIC DESCRIPTION

Figure 1A:
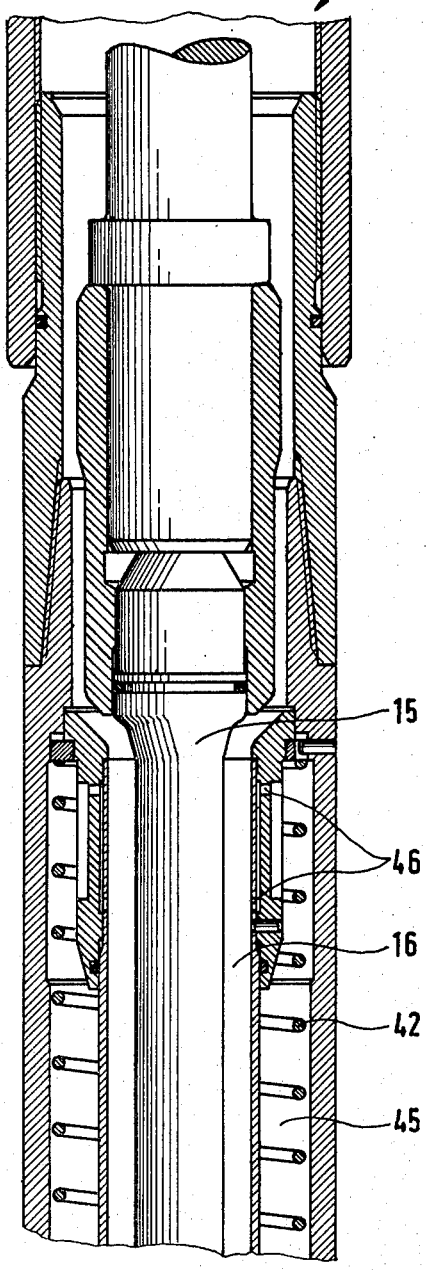
FIGS. 1*a* through 1*d* represent successive views in a section through the direct drill bit drive.
Figure 1B:
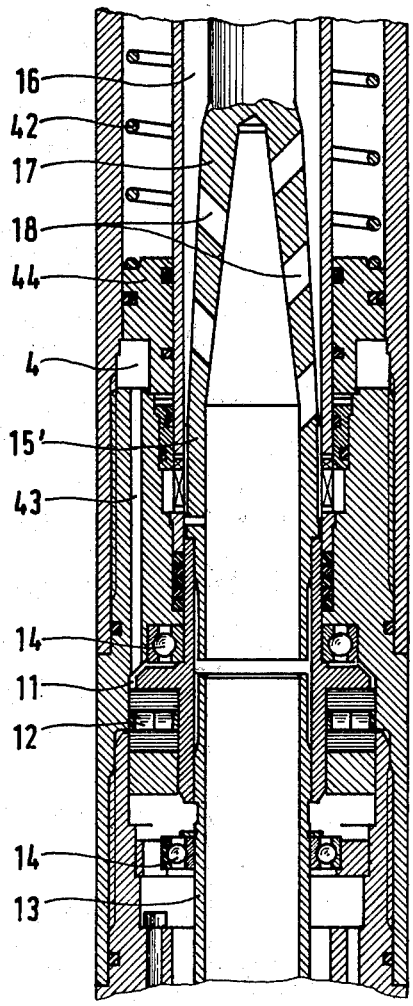
Figure 1C:
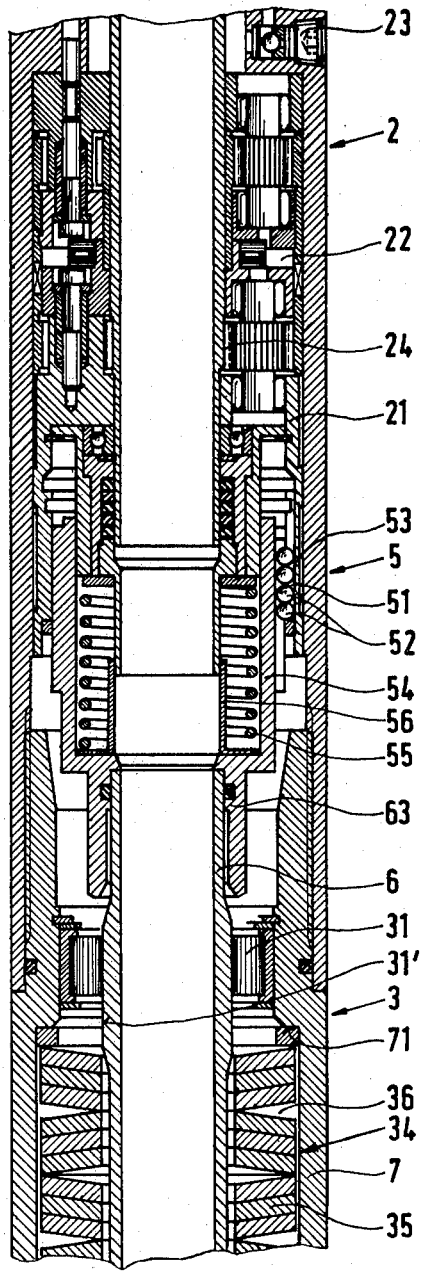
Figure 1D:
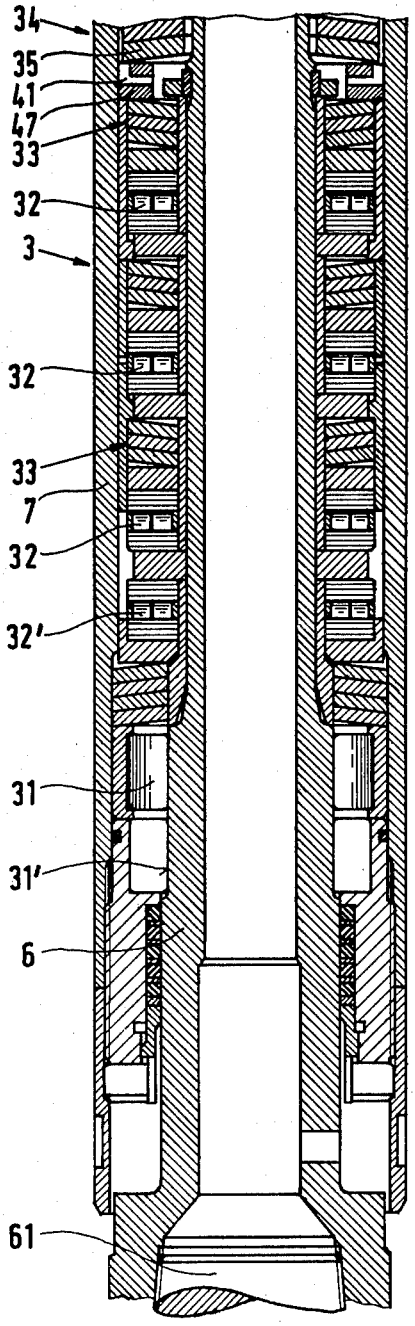

FIGS. 1*a*–1*d* show the direct drill bit drive, in which the drive section 1 is shown only partly, whereas the gear section 2 and bearing section 3 are complete. Between the drive section and gear section there is located the oil reservoir 4, which is connected by channels 43 to the oil-tight annular space 11, 22, 36. A pressure difference is established between the oil reservoir and the surroundings by means of a compression spring 42. The possible volume of the reservoir 4 must be such as to compensate for all oil leakages from the entir annular space during the service life of the drill bit. In addition to the necessary radial bearings 14, at least one axial bearing 12 is disposed between the drive section and gear section. Likewise, between the gear section 2 and bearing section 3 there are disposed in the annular space a coupling 5 with an outer ring 53, an inner ring 54 and rolling elements 52, which are located in grooves 51 in said rings. The annular space 36 of the bearing section 3 contains radial bearings 31 with internal or external widened running surfaces 31', axial bearings 32 provided with a load compensation device 33, and spring elements 34 which in this embodiment are in the form of cup springs 35. The drill bit 61 is fitted to the inner tube 6.

If the cup springs 35 are arranged in opposing directions, then upon stacking them into a spring column, hollow spaces 36 are formed between the opposing conical surfaces of the cup springs, and are filled with oil. Upon inward springing the spring elements, this oil is compressed. With cooperating contact surfaces of the cup springs and high axial load, these contact surfaces are substantially impermeable to the compressed oil. This must then flow out between the outer edges of the cup springs and the wall of the outer tube. A connection is made to the remaining oil space by means of restrictor passages 41 disposed in a pressure ring 47 between the spring elements 34 and the axial bearings 32. By this means, upon axial movement of the spring elements, oil is transferred through the restrictor passages 41, thereby damping such movements.

The rotary movement, e.g. of a turbine in the drive section 1, is transmitted by way of the shaft 15 and the hollow shaft (inner tube) 13 to the inner central wheel 24 in the gear section 2, and is then transferred e.g. by way of the planet carrier (drive output member) 21 to the outer ring 53 of the coupling 5. The support for the shaft 15, which in its lower region is in the form of a hollow shaft 15', prevents, by virtue of the axial bearing 12, a transfer of the axially acting turbine thrust force to the hollow shaft 13 and thus to the gear section 2. This region of the drive is fixed in the axial direction. At the same time, the turbine itself is freed from the axially acting turbine thrust force, this being advantageous for the service life of the turbine bearings.

In the region of the bearing section 3, the inner tube 6, to which the drill bit 61 is fixed is connected in a rotatably and axially rigid manner to a tubular member 63, the top of which forms the largest diameter part of the inner ring 54 of the coupling 5. Because of the widened running surfaces 31' of the radial bearings 31 and the sprung mounting of the axial bearings 32 in the bearing unit 3, it is possible for the inner tube 6 to develop a relatively large axial movement, so that a very large part of the pulsating overloads and vibration due to the influence of the drilled rock can be prevented. In this case, the coupling cooperating with the rolling elements 52 located in the grooves of the outer ring 53 and inner ring 54 can transmit very high torques, and facilitate the axial displacement of the inner tube 6.

The flushing medium, which for example simultaneously forms the drive medium, firstly flows through the inner annular space 16 which surrounds the drive shaft 15. In the region of the transition 17 between the shaft 15 and the hollow shaft 15', openings 18 are provided through which the flushing medium is fed into the inner tube 13, and later the inner tube 6. The axial displacement of the inner tube 6 is accommodated in the region of the coupling 5 by means of an intermediate tube 56 which is loaded by a spring 55, so that a wall is present for the flow of the flushing medium basically throughout.

The oil-tight annular space 11, 22, 36 is filled through the valve 23 between the annular space 11 and 22. After it has been completely filled, the oil reservoir 4 is filled through channels 43, whereby the oil pressure which builds up displaces the piston 44 against the pressure of the spring 42 in the direction of the drive section 1. The spring compartment 45 of the spring 42 for the oil reservoir 4 is connected by openings 46 to the annular space 16 through which the flushing medium is led to the inner tube 6, so that the static pressure of the flushing medium also acts in this spring compartment, and the piston 44 of the oil reservoir 4 is acted upon, effecting pressure equalisation, and substantially unloading the seals from the surrounding pressure in the bore hole.

Figure 2:
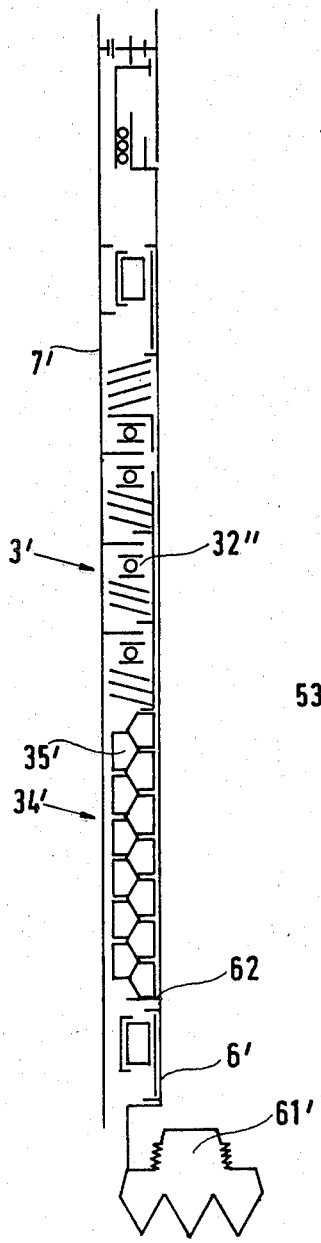
FIG. 2 shows the bearing section with a different arrangement of the bearings and spring elements.

FIG. 2 shows an alternative arrangement of the bearings and spring elements in the region of the bearing section 3 (FIG. 1). Whereas in FIGS. 1*c* and 1*d* the axial bearings 32, 32' move in an axial direction with the inner tube 6, and the spring elements 34 are supported on the outer tube 7, in this case the support is effected on the inner tube 6' against the stop 62, and the axial bearings 32'' are fixed to the outer tube 7' in a basically axially rigid manner.

Figure 3:
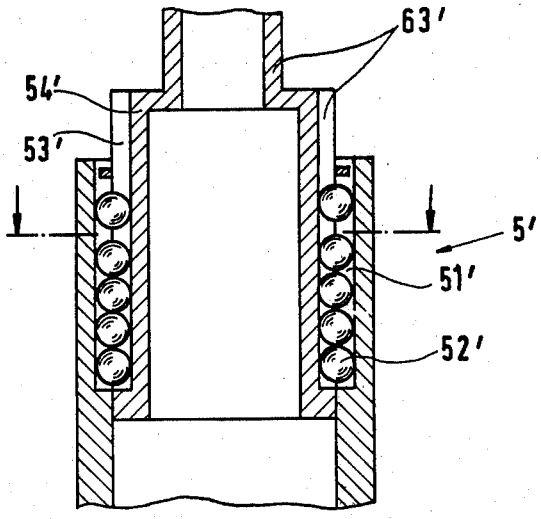
FIGS. 3*a* and 3*b* are respectively a longitudinal and cross-section through the coupling.
Figure 3:
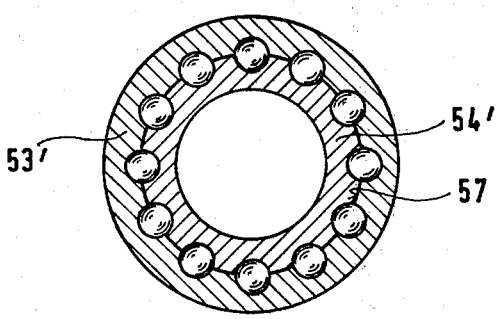

The coupling 5' (FIG. 1) is again shown diagrammatically in FIG. 3. Mutual bores 51' provided on the separation line between the outer ring 53' and inner ring 54' in an axial direction and distributed over the circumference produce cup-shaped grooves which can vary in length and number over a wide range. By this means, it is possible to ensure to a sufficient extent the axial, easy-action displaceability of the member 63' connected to the inner tube, even under high load. In addition, several balls 52' can be fitted into a bore 51'—respective half cup in the inner and outer ring—and several bores 51' can be disposed on the circumference, so that the coupling can be matched to the torque to be transmitted.

We claim:

1. A direct-drive drill string comprising:

an upper tubular drive section provided with a drive motor having a shaft and adapted to be traversed and driven by a flushing liquid;

a gear section below said drive section and provided with gearing driven by said shaft and formed with an output member;

a bearing section below said gear section, a plurality of radial bearings rotatably journaling said inner tube, all of said sections having a non-rotating outer tube, a rotating inner tube in at least said bearing section, and radial bearings disposed between said inner and said outer tubes, at least one of said radial bearings having inner and outer races of which one is axially elongated to accommodate axial movement of said inner tube relative to said outer tube;

a drill bit connected to said inner tube below said bearing section and rotatably entrained by said inner tube;

means defining an annular space between said inner and outer tubes intermediate said drive section and said gear section;

means for introducing oil into said annular space whereby said annular space serves as an oil reservoir;

at least one axial bearing in contact with oil from said reservoir for receiving axial force generated by said motor upon the operation thereof by said liquid;

means for angularly coupling the inner tube connected to said bit with said output member of said gearing so as to permit axial displacement of the inner tube carrying said bit within said outer tube;

spring means braced between said inner tube carrying said bit and said outer tube for yieldably resisting axial displacement of said inner tube carrying said bit; and further axial bearings cooperating with said spring means and the inner tube carrying said bit for enabling rotation of said inner tube carrying said bit while spring force is applied thereto, said flushing liquid passing through said inner tube to said bit.

2. The direct-drive drill string defined in claim 1 wherein said spring means includes a stack of spring elements braced between a stop on said outer tube and on said one of said radial bearings.

3. The direct-drive drill string defined in claim 1 wherein said spring means includes spring elements braced between a stop on said inner tube connected to said drill bit and said one of said radial bearings.

4. The direct-drive drill string defined in claim 2 or claim 3 wherein said spring elements are cup springs.

5. The direct-drive drill string defined in claim 2 or claim 3 wherein said spring means is a multi-layer coil spring having conical contact surfaces.

6. The direct-drive drill string defined in claim 1, further comprising passages connecting said reservoir with said bearing section, and flow restrictors in said passages between said spring means and said reservoir.

7. The direct-drive drill string defined in claim 1 wherein said means for angularly coupling the inner tube connected to said bit with said output member comprises a pair of members receiving roller elements between them with at least one of the roller elements of the pair being formed with axially extending grooves in which said elements are guided.

8. The direct-drive drill string defined in claim 7 wherein such grooves are provided in bearing members of said pair and form axial bores receiving said elements, said elements being balls.

* * * * *